US005316527A

United States Patent [19]

Lekhtman

[11] Patent Number: 5,316,527

[45] Date of Patent: May 31, 1994

[54] COLLAPSIBLE SUPPORT FOR RUNNING IN PLACE EXERCISING

[76] Inventor: Gregory Lekhtman, 1260 Dr. Penfield Ave., Apt. 902, Montreal, Quebec, Canada, H3G 1B6

[21] Appl. No.: 900,850

[22] Filed: Jun. 18, 1992

[51] Int. Cl.[5] ..... A63B 26/00

[52] U.S. Cl. ..... 482/41; 482/38; 482/908

[58] Field of Search ..... 482/38, 41, 42, 54, 482/140, 141, 142, 148, 908, 66, 27, 28

[56] References Cited

U.S. PATENT DOCUMENTS

| | | | |
|---|---|---|---|
| 2,991,841 | 7/1961 | Sampson et al. | 482/27 |
| 3,442,276 | 7/1969 | Edwards et al. | 482/66 |
| 3,688,789 | 9/1972 | Bunch | 482/66 |
| 3,690,652 | 9/1972 | Schneider | 482/66 |
| 3,695,609 | 10/1972 | Rothe | 482/66 |
| 4,021,033 | 5/1977 | Auclair et al. | 482/66 |
| 4,135,535 | 1/1979 | Thomas | 482/66 |
| 4,722,356 | 2/1988 | Rehder | 482/66 |
| 4,729,395 | 3/1988 | Adamson | 482/66 |
| 4,748,994 | 6/1988 | Schultz et al. | 482/66 |
| 4,777,976 | 10/1988 | Nakajima | 482/66 |
| 4,869,279 | 9/1989 | Hedges | 482/66 |
| 4,941,496 | 7/1990 | Berning | 482/66 |

*Primary Examiner*—Richard J. Apley
*Assistant Examiner*—Lynne A. Rechard
*Attorney, Agent, or Firm*—Chilton, Alix & Van Kirk

[57] ABSTRACT

A handle arrangement is disposed at the top end of the support and a base at the bottom end. The handle and the base are spaced from each other by a spacer, and the handle is disconnectably connectable to the spacer at one end while the base is disconnectably connectable to the spacer at the other end. The handle, spacer and base comprise tubular members.

11 Claims, 5 Drawing Sheets

COLLAPSIBLE SUPPORT FOR RUNNING IN PLACE EXERCISING

BACKGROUND OF THE INVENTION

1. Field of the Invention

The invention relates to a collapsible support arrangement for running in place exercising. The invention also relates to an improved sporting shoe to be worn when using the arrangement.

2. Description of Prior Art

Running in place exercisers, for example, treadmills or the like, typically are fixed-in-place machines which require an elaborate set-up and a fair amount of space, and which cannot easily be moved from place to place.

SUMMARY OF INVENTION

It is an object of the invention to provide a support arrangement for running in place exercising which overcomes the disadvantages of the prior art.

It is a more specific object of the invention to provide such a support which is collapsible and therefore easily movable, and which requires only a limited amount of space.

It is also an object of the invention to provide an improved sporting shoe for use in association with the support.

In accordance with a specific embodiment of the invention there is provided a collapsible support arrangement for running in place exercising, comprising:

handle means;

spacer means having a first end and a second end; and base means;

said handle means, spacer means and base means comprising tubular members;

said handle means being disconnectably connectable to said first end of said spacer means; and said base means being disconnectably connectable to said second end of said spacer means.

In accordance with a further specific embodiment of the invention there is provided a collapsible support arrangement for running in place exercising, comprising:

handle means comprising two handle tube members each handle tube member having a first end and a second end;

said first ends of said handle tube members being spaced from each other and a portion of said handle tube members adjacent said second ends of said handle tube members being disposed in side-by-side arrangement;

spacer means comprising two spacer tubes disposed in side-by-side arrangement, each spacer tube having a first end and a second end, a respective one of said spacer tubes being disconnectably connectable, at the first end thereof, to a respective one of said handle tube members at the second end thereof;

base means comprising two base tubes each having a first end and a second end, a respective one of the base tubes being connected, at the first end thereof, to a respective one of said spacer tubes at the second end thereof.

From a different aspect, and in accordance with a specific embodiment of the invention there is provided a sporting shoe comprising;

a spring member having a top surface;

platform means mounted on said top surface and having a front end and a rear end;

toe restraining means at said front end of said platform means;

left and right pivoting wings;

left and right pivoting members each associated, respectively, with one of said left and right pivoting wings for pivoting said pivoting wings into an upright position; and strap means for binding said pivoting wings to the leg of a user.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
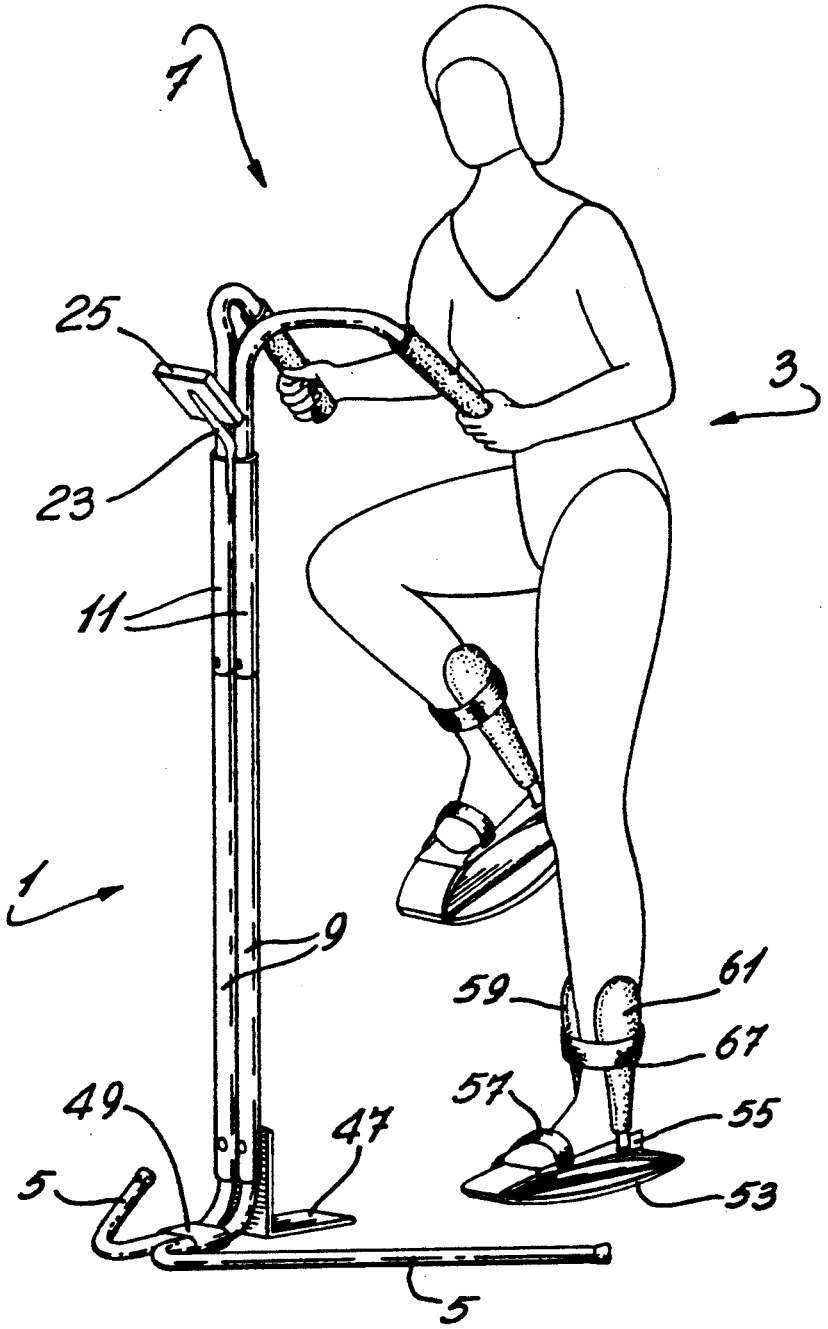
FIG. 1 is a perspective view of the novel support arrangement as being used by an exerciser.

Referring to the drawings, the exercise support arrangement, illustrated generally at 1 and being used by an exerciser 3, consists of a base means 5, a handle means 7 and a spacer means comprising a bottom spacer means 9 and a top spacer means 11. The free ends of the handle means include a covering (see FIG. 2) 13 which can be rubber or other suitable material as well known in the art. As can be seen, the base means, handle means and spacer means are all made of tubular members.

Figure 4:
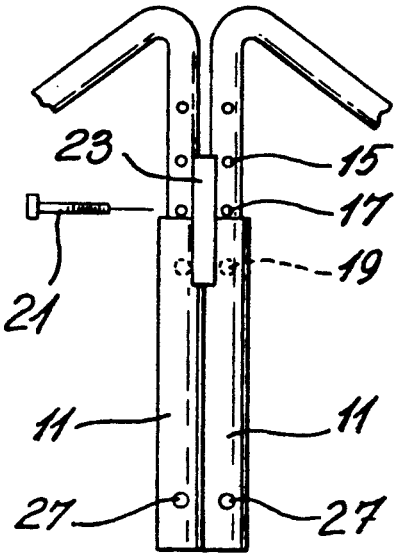
FIG. 4 shows the telescoping connection of the handle into the spacer.
Figure 5:
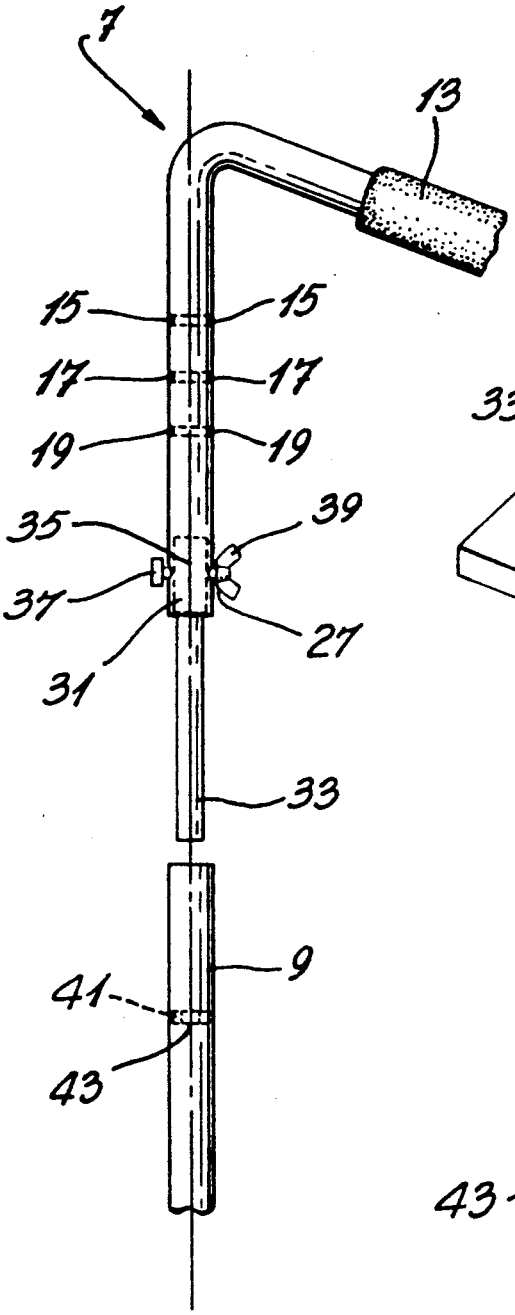
FIG. 5 is an exploded view of a different portion of the support arrangement.

The handle means comprise two handle tube members having vertically extending portions disposed in side-by-side arrangement and second portions which are integrally formed at substantially right angles to the vertically extending portions. The handle means include height adjusting means consisting of aligned openings 15, 17 and 19 (See FIGS. 2 and 4) in each of the tubes. As can be seen in FIG. 5, the openings extend through the tubes. A pin 21 is inserted through a selected opening to adjust the height of the handles.

The diameter of the handle tubes is less than the diameter of the tubes forming the upper spacers 11. It can be seen that the tubes forming the upper spacers 11 are also disposed in side-by-side arrangement. To disconnectably connect the handle means to the spacer means, a respective one of the tubes at the end of the handle means are inserted into a respective one of tubes 11. The pin 21 prevents the handle from descending any further into the spacer means.

A support 23 is mounted just below the handle means for mounting, for example, a computer 25 or the like.

Figure 6:
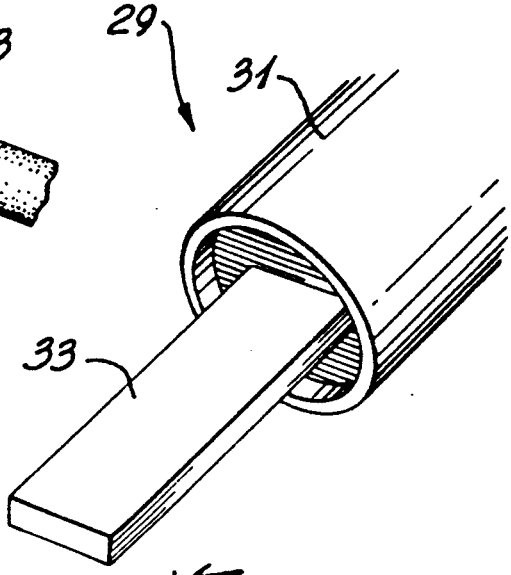
FIG. 6 is an inset in FIG. 5.

Openings 27 are included at the bottom end of the top spacers 11 and, as seen in FIG. 5, the opening 27 extend through the tubes 11. In order to make the upper spacer means 11 disconnectably connectable from the lower spacer means 9, insert 29 is inserted into the tubes 11 and 9. Referring to FIG. 6, the insert 29 includes a top cylindrical portion 31 and a bottom key 33. As seen in FIG. 5, the cylindrical portion 31, which has a diameter smaller than the diameter of the tube 11 and includes an opening 35 which extends through the cylinder 31. In operation, the opening 35 is aligned with the opening 27 and a bolt 37 is extended through the aligned openings. A wing nut 39 is then mounted on the free end of the bolt 37 whereby the insert 29 is removably fixedly mounted in the tubes 11. The key 33 extends outwardly of the bottom end of the top spacer tube 11.

Figure 7:
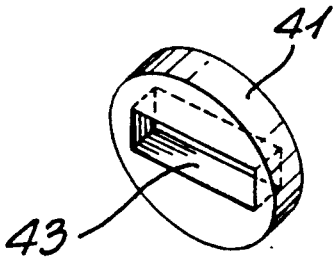
FIG. 7 is a second inset in FIG. 5.

As seen in FIG. 5, a plug 41 having a keyhole 43 is fixedly mounted in the bottom spacer tube 9. A perspective view of the tube is shown in FIG. 7.

In operation, after the insert has been fixedly mounted in the tube 11, the key 33 is extended downwardly through the top end of bottom spacer tube 9 and the key will then be directed into the keyhole 43. This will ensure the alignment of the upper spacer tube 11 with the lower spacer tube 9.

Figure 2:
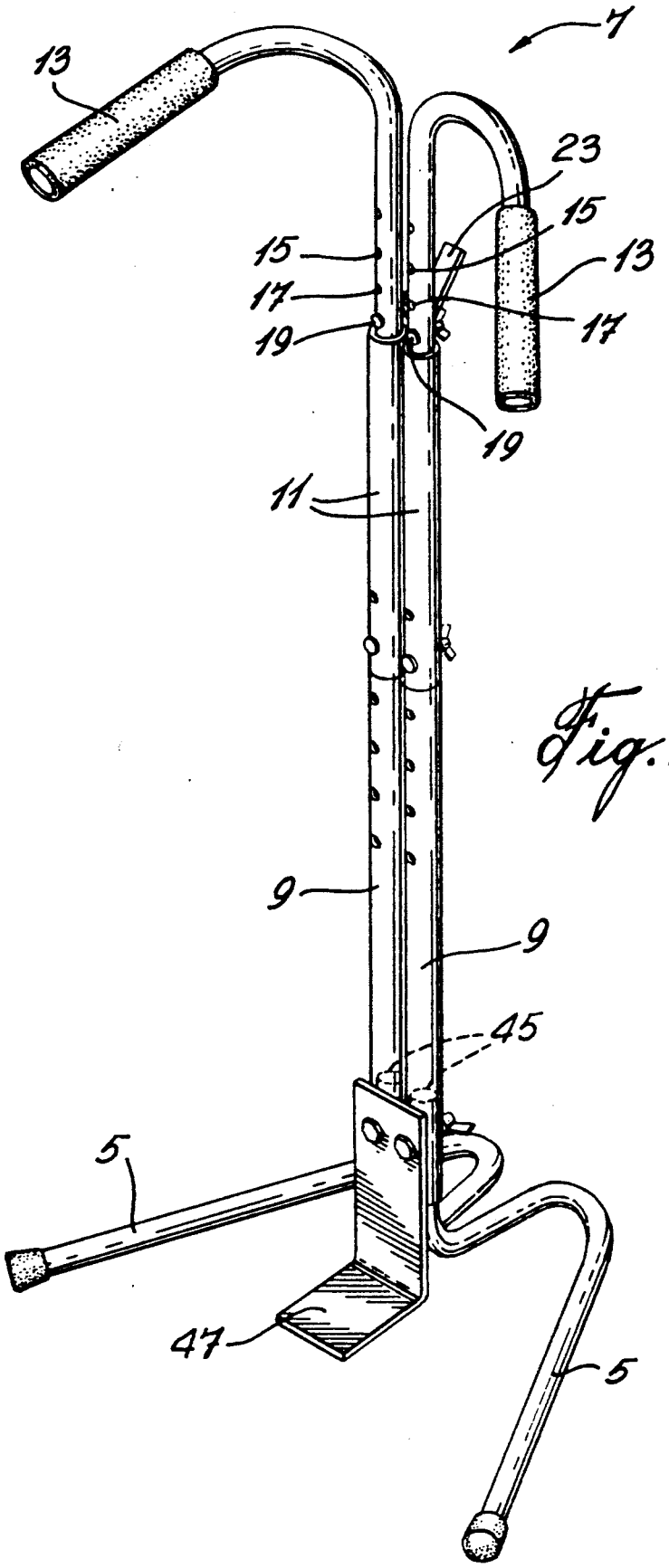
FIG. 2 is a perspective view of the support arrangement showing further detail.
Figure 3:
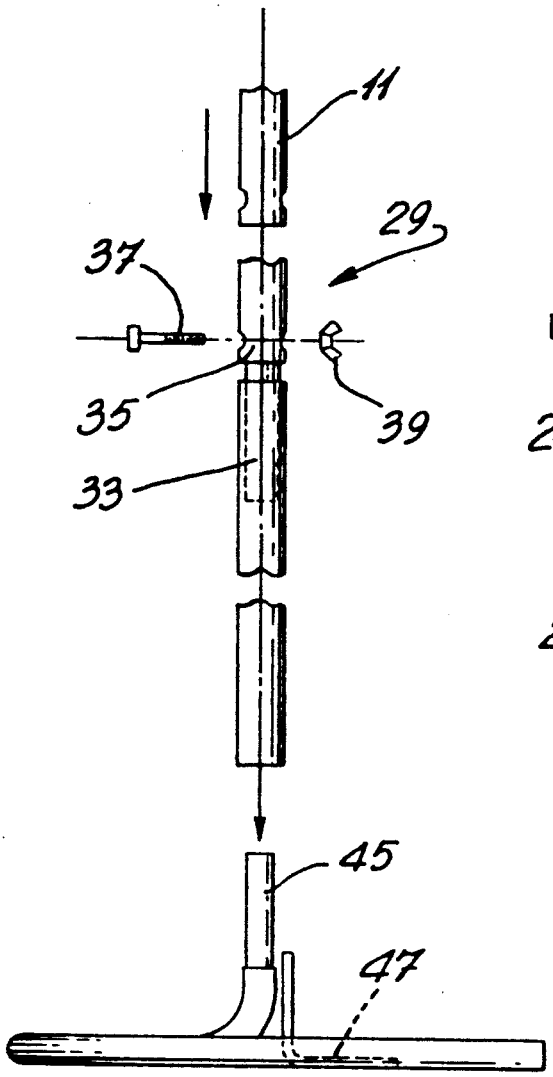
FIG. 3 is a exploded view of a portion of the support arrangement.

Referring now to FIGS. 1 and 2, it can be seen that the base 5 comprises two vertically extending side-by-side tubes and two horizontally extending side-by-side tubes which are formed integrally and at right angles to the vertically extending tubes. Extending from each horizontal tube at an obtuse angle thereto and integrally formed with the horizontal tubes are two flaring members which flare away from each other. The two tubular sections of the support are connected to each other by a clip 49 which is mounted over the horizontally extending portions of the base.

Angle irons 47 are connected to each one of the vertically extending portions to provide greater support on the ground.

A bottom insert 45 is used for the purpose of disconnectably connecting each base tube to a respective one of the spacer tubes. The insert 45 comprises a tubular member having a diameter which is smaller than the diameter of the base member and smaller than the diameter of the spacer. In operation, the bottom insert is inserted into each base tube and a respective one of the spacer tubes is then mounted on a respective insert by overlapping the spacer tubes onto the inserts.

It will be seen that each handle is rotatable relative to its spacer so that the handles can be swung in an arc in a horizontal plane. However, the size of the arc is limited as the pin 21 will eventually engage the item 25 mounted on support 23.

It will also be seen that the support is completely collapsible into small enough pieces so that it can be easily carried in a carrying bag.

Figure 9:
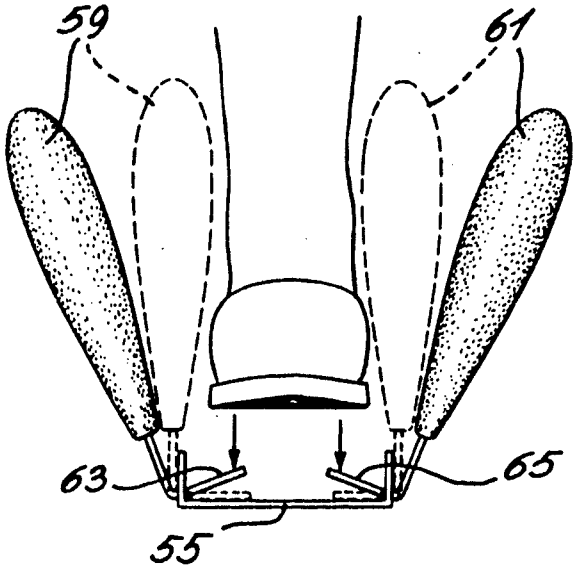
FIG. 9 is a front view of the shoe.
Figure 8:
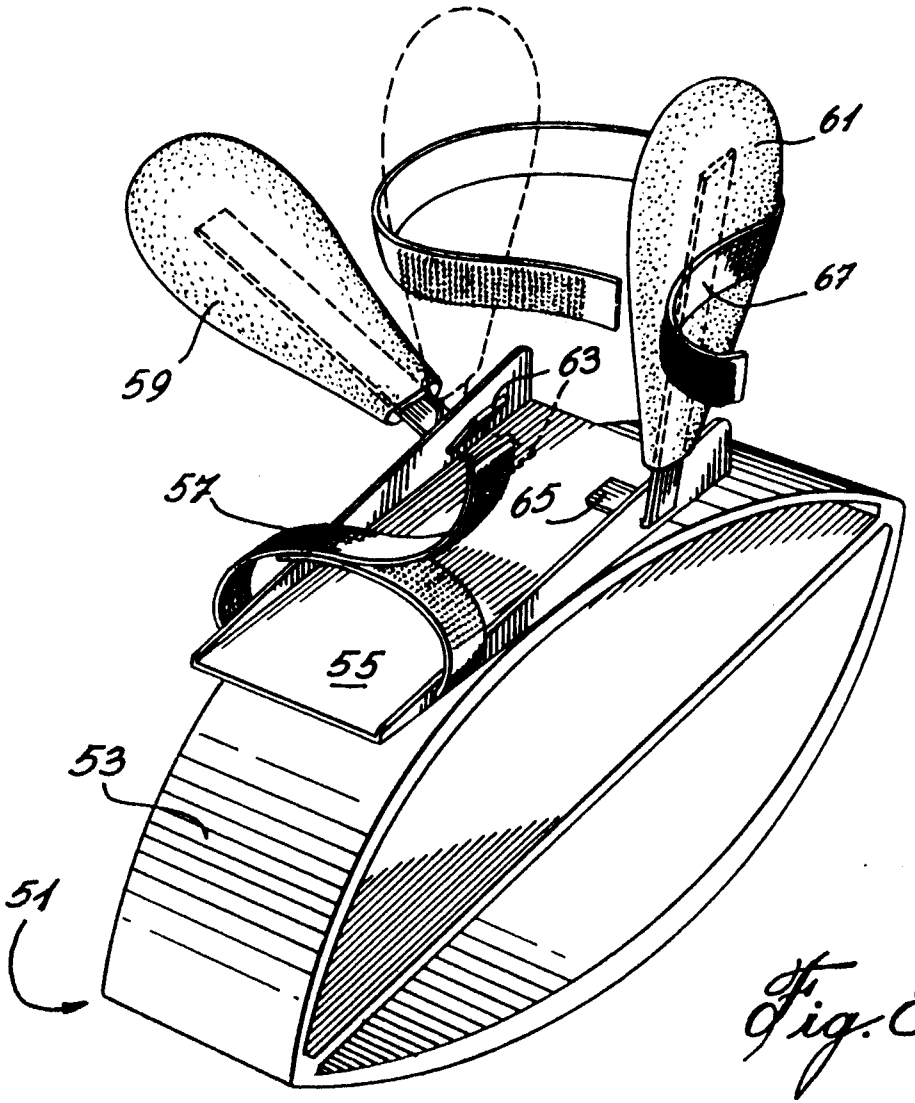
FIG. 8 is a perspective view of a sporting shoe to be used in association with a support.

Sporting shoes particularly useful in association with the support are illustrated in FIGS. 8 and 9. Referring to FIGS. 8 and 9, the shoe comprises a spring member 53 having a platform 55 mounted on the top surface thereof. A toe restrainer 57 is mounted at the front end of the platform. The toe restrainer is a strap-like arrangement which preferably comprises a releasable self-locking fabric material such as the material sold under the trademark VELCRO.

Disposed at the rear end of the platform are pivotable wings 59 and 61 and pivoters 63 and 65 associated with the wings 59 and 61 respectively. A strap 67, which once again preferably comprises a releasable self-locking fabric material can be wrapped around the leg of a user as shown in FIG. 1. In operation, and as best seen in FIG. 9, when the foot of a user is lowered onto the platform, it engages the pivoters 63 and 65 so that the wings 59 and 61 will be moved into an upright position. The toe restrainer 57 is then wrapped around the toe and the ends thereof are fastened to each other. The strap 67 is wrapped around the leg of the user and the two ends thereof are, once again, attached to each other.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A collapsible support for running in place exercising comprising:

handle means;

spacer means having a first end and a second end; and base means;

said handle means, spacer means and base means comprising tubular members;

said handle means being disconnectably connectable to said first end of said spacer means; and said base means being disconnectably connectable to said second end of said spacer means;

said spacer means comprising two spacer tubes, each spacer tube having a first end and a second end corresponding with the first end and the second end of said spacer means, said spacer tubes extending in straight, abutting, side-by-side relationship between said first ends and said second ends thereof;

said base means including two base tubes, each base tube having a first portion, adjacent a second end of a respective spacer tube, said first portions of said base tubes extending in alignment with said spacer tubes, and each base tube having a second portion, extending from a respective one of said first portions, and at right angles thereto;

L-shaped bracket means having a vertical section and a horizontal section, said vertical section being connected to said first portions of said base tubes and said horizontal section extending in alignment with said second portions of said base tubes but in a direction opposite thereto.

2. A support as defined in claim 1 wherein said handle means is disconnectably connectable to said first end of said spacer means by a telescoping arrangement.

3. A support as defined in claim 2 wherein said base means is disconnectably connectable to said second end of said spacer means by means insertable into adjacent ends of said first portions of said base tubes and said second ends of said spacer tubes.

4. A support as defined in claim 3 wherein said spacer means comprises upper spacer means and lower spacer means;

said upper spacer means having a top end comprising a first end of said spacer means and a bottom end;

said lower spacer means having a bottom end comprising the second end of said spacer means and a top end;

said upper spacer means being disconnectably connectable to said lower spacer means.

5. A support as defined in claim 4 wherein said upper spacer means comprises two upper spacer tubes and said lower spacer means comprises two lower spacer tubes and wherein said upper spacer tubes are disconnectably connectable to said lower spacer tubes by means insertable into adjacent ends of said upper spacer tubes and said lower spacer tubes.

6. A support as defined in claim 5 and further including means for adjusting the height of said handle means.

7. A collapsible support for running in place exercising comprising:

handle means comprising two handle tube members each handle tube member having a first end and a second end;

said first ends of said handle tube members being spaced from each other and a portion of said handle tube members adjacent said second ends of said handle tube members being disposed in side-by-side arrangement;

spacer means comprising two spacer tubes disposed in side-by-side arrangement, each spacer tube having a first end and a second end, a respective one of said spacer tubes being disconnectably connectable, at the first end thereof, to a respective one of said handle tube members at the second end thereof;

base means comprising two base tubes each having a first end and second end, a respective one of the base tubes being connected, at the first end thereof, to a respective one of said spacer tubes at the second end thereof;

said spacer tubes extending in straight, abutting relationship between said first ends and said second ends thereof;

each of said base tubes of said base means including a first portion, adjacent a respective one of the second ends of said respective spacer tubes, and extending in alignment with said spacer tubes, and each base tube further including a second portion, extending from a respective one of said first portions, and at right angles thereto;

L-shaped bracket means having a vertical section and a horizontal section, said vertical section being connected to said first portions of said base tubes and said horizontal section extending in alignment with said second portions or said base tubes but in a direction opposite thereto.

8. A support as defined in claim 7 and including bottom inserts mounted in and extending from the first end of each one of said base tubes, said bottom inserts comprising tubular members having a diameter less than the diameter of said base tubes;

the diameters of said bottom inserts also being less than the diameters at the second ends of said spacer means;

whereby, said spacer means is disconnectably connectable to said base means by mounting a respective one of said lower spacer tubes on a respective one of said bottom inserts.

9. A support as defined in claim 8 and including spacer insert means for disconnectably connecting said upper spacer tubes to said lower spacer tubes;

each said spacer insert means comprising a cylindrical portion and a key portion;

means for fixing respective one of said cylindrical portions in a respective one of said upper spacer tubes;

plug means in each of said lower spacer tubes, each said plug means having a keyhole for receiving a respective one of said keys of said spacer inserts;

whereby to disconnectably connect said upper spacer tubes to said lower spacer tubes.

10. A support as defined in claim 9 wherein each handle tube member comprises a first straight portion;

a second straight portion formed integrally at right angles to said first straight portion;

each said first straight portion having a bottom end, said bottom ends of said first straight portions comprising said second ends of said handle tube members;

said first straight portions being disposed in side-by-side arrangement;

adjustment means in said first straight portions for adjusting the height of said handle means.

11. A support as defined in claim 10 wherein said adjustment means comprises a plurality of aligned openings extending along the length of said first portions; and pin means for extending through selected ones of said openings.

* * * * *